US012601032B1

(12) United States Patent
Tang et al.

(10) Patent No.: US 12,601,032 B1
(45) Date of Patent: Apr. 14, 2026

(54) COMPREHENSIVE UTILIZATION METHOD OF BENEFICIATION-METALLURGY-CHEMICAL COMBINATION FOR GERMANIUM-RICH LIGNITE

(71) Applicant: CENTRAL SOUTH UNIVERSITY, Changsha (CN)

(72) Inventors: Honghu Tang, Changsha (CN); Feng Jiang, Changsha (CN); Yixin Fu, Changsha (CN); Qi Xiong, Changsha (CN); Bingjian Liu, Changsha (CN); Zhenyue Zhang, Changsha (CN); Li Wang, Changsha (CN); Wei Sun, Changsha (CN)

(73) Assignee: CENTRAL SOUTH UNIVERSITY, Changsha (CN)

( * ) Notice: Subject to any disclaimer, the term of this patent is extended or adjusted under 35 U.S.C. 154(b) by 0 days.

(21) Appl. No.: 19/270,603

(22) Filed: Jul. 16, 2025

(30) Foreign Application Priority Data

Jan. 22, 2025 (CN) ..... 202510100358.X

(51) Int. Cl.

| | |
|---|---|
| ***C22B 41/00*** | (2006.01) |
| ***C22B 1/24*** | (2006.01) |
| ***C22B 3/06*** | (2006.01) |
| ***C22B 3/42*** | (2006.01) |

(52) U.S. Cl.
CPC ..... *C22B 41/00* (2013.01); *C22B 1/24* (2013.01); *C22B 3/065* (2013.01); *C22B 3/42* (2013.01)

(58) Field of Classification Search
None
See application file for complete search history.

(56) References Cited

FOREIGN PATENT DOCUMENTS

| | | | | |
|---|---|---|---|---|
| CN | 112410584 A | * | 2/2021 | ..... C22B 7/007 |
| CN | 114262794 A | * | 4/2022 | |
| ES | 2257181 A1 | * | 7/2006 | ..... C22B 41/00 |

OTHER PUBLICATIONS

HJ 1095-2020, Technical Specifications of Fenton Oxidation Process for Wastewater Treatment, 2020, pp. 1-19, China Environmental Science Press.

* cited by examiner

*Primary Examiner* — Keith D. Hendricks
*Assistant Examiner* — Nikolas Takuya Pullen
(74) *Attorney, Agent, or Firm* — Bayramoglu Law Offices

(57) ABSTRACT

A comprehensive utilization method of beneficiation-metallurgy-chemical combination for germanium-rich lignite includes the following steps: 1) germanium-rich lignite sizing and grinding, 2) catalytic pre-oxidation, 3) nitric acid leaching, and 4) recycling and enrichment of germanium solution. The high effective extraction of germanium from the germanium-rich lignite was achieved via a combination of mineral beneficiation, hydrometallurgy, and chemical processing. Meanwhile, a high yield and high degree of depolymerization humic acid product was produced as byproducts. This method could not only effectively avoid high carbon emission and organic resource waste during conventional germanium-rich lignite pyrometallurgical processing, but also could produce humic acid as quality raw materials for metallurgical and agricultural industries, which has advantages of less environmental pollution, high extraction efficiency, and low comprehensive costs.

13 Claims, 2 Drawing Sheets

COMPREHENSIVE UTILIZATION METHOD OF BENEFICIATION-METALLURGY-CHEMICAL COMBINATION FOR GERMANIUM-RICH LIGNITE

CROSS REFERENCE TO THE RELATED APPLICATIONS

This application is based upon and claims priority to Chinese Patent Application No. 202510100358.X, filed on Jan. 22, 2025, the entire contents of which are incorporated herein by reference.

TECHNICAL FIELD

The present invention relates to a comprehensive utilization method of beneficiation-metallurgy-chemical combination for germanium-rich lignite, and belongs to the field of comprehensive recovery technologies of solid materials.

BACKGROUND

In China, reserves of lignite amount to 130 billion tons, with reserves of germanium resources of about 8000 tons to 10000 tons. Proven reserves of germanium metal have reached 3332.45 tons only in the Wulantuga mine of Xilingol League in Inner Mongolia Autonomous Region, accounting for about 30% of the world's proven germanium reserves. Therefore, Inner Mongolia Autonomous Region has become a new "germanium capital" of China, following Yunnan.

However, germanium-rich lignite has a low carbon content (50% to 70%), a high moisture content (15% to 60%), and a low grade of germanium (about 200 ppm). Efficient and comprehensive methods for treatment and utilization of the germanium-rich lignite are still limited. In an existing mainstream process, germanium-rich lignite is first subjected to high-temperature combustion and oxidation by pyrometallurgical processing to pre-enrich germanium to soot or slag, followed by chlorination and distillation to extract germanium from the enrichment product. This process has a long process flow, high energy consumption, high reagent consumption, and low germanium recovery. In addition, the pyrometallurgical processing of 1 ton lignite would release 1.83 tons to 2.57 tons of carbon dioxide, while providing a calorific value less than 3000 kcal, resulting in low carbon resource utilization and high carbon emission. All these problems seriously restrict the development of germanium extraction industry from germanium-rich lignite. Therefore, there is an urgent need to develop a low-carbon, economical, and efficient technique for extraction, separation, and comprehensive utilization that matches characteristics of key germanium metal resources and carbon resources in germanium-rich lignite.

At present, extraction of germanium resources from lignite primarily includes two main techniques: hydrometallurgical processing and pyrometallurgical processing. In addition, there are many related studies focusing on secondary enrichment of germanium from germanium-containing soot, and separation and recovery of germanium extracted from lignite in a solution. A typical process of hydrometallurgical extraction from germanium-rich lignite is hydrochloric acid leaching, chlorination, and distillation. The lignite is ground and mixed, then treated with a high-concentration (greater than 7 mol/L) hydrochloric acid solution under heating to directly leach germanium from the lignite, and then distilled to obtain germanium tetrachloride. However, this process requires a high concentration and large volume of hydrochloric acid, leading to high industrial costs, and the distillation residue contains a high concentration of hydrochloric acid and many impurities such as arsenic and iron, making it difficult to reuse or treat. As a result, this process is not yet applicable for large-scale production. For pyrometallurgical extraction from germanium-rich lignite, usually, the germanium-rich lignite is first subjected to high-temperature combustion by pyrometallurgical processing to transfer germanium into soot or slag, followed by conventional chlorination and distillation to extract germanium from a germanium-enriched product. In this process, germanium is prone to being wrapped by silica, forming germanium-silica co-solutes, which increases the difficulty of germanium extraction by subsequent chlorination and distillation. Moreover, many studies focus on secondary enrichment of germanium from germanium-containing soot, mainly involving typical chlorination and distillation, controlled-atmosphere reduction and volatilization, fuming volatilization, sodium roasting and neutralization, and the like. However, these methods only target recovery of germanium resources, but main organic matter in lignite is almost not utilized.

SUMMARY

To resolve the problems of low germanium leaching and low organic matter utilization in recovery and utilization methods for germanium-rich lignite in the related art, an objective of the present invention is to provide a comprehensive utilization method of beneficiation-metallurgy-chemical combination for germanium-rich lignite. Through the combination of advantages of mineral beneficiation, hydrometallurgy, and chemical preparation, this method can significantly improve one-time direct hydrometallurgical germanium extraction through pre-activation of germanium-rich lignite by catalytic oxidation, and significantly reduce consumption of a leaching agent and duration for leaching under heating compared with direct acid leaching, improving organic matter activation, depolymerization, and extraction. In addition, the present invention can greatly reduce a length of a comprehensive utilization technology route, effectively reducing costs of the overall process.

To achieve the foregoing technical objective, the present invention provides a comprehensive utilization method of beneficiation-metallurgy-chemical combination for germanium-rich lignite, including the following steps:

(1) performing mineral processing classification on the germanium-rich lignite to remove mud particles, and grinding an obtained oversize product to obtain raw lignite;

(2) mixing the raw lignite, hydrogen peroxide, and a ferrous ion solution to perform catalytic pre-oxidation, performing solid-liquid separation to obtain an activated solution (a) and an activated lignite residue, and returning the activated solution (a) to the catalytic pre-oxidation step for recycling, to implement preliminary germanium enrichment and obtain a preliminarily enriched germanium bearing solution (a);

(3) performing germanium leaching on the activated lignite residue with nitric acid, performing solid-liquid separation to obtain a germanium bearing solution (b) and a humic acid-rich solid product with a high degree of depolymerization, and returning the germanium bearing solution (b) to the germanium leaching step for recycling, to implement preliminary germanium enrichment and obtain a preliminarily enriched germanium bearing solution (b); and (4) performing adsorption with anion exchange resin on the preliminarily enriched germanium bearing solution (a) and the preliminarily enriched germanium bearing solution (b) separately or on the preliminarily enriched germanium bearing solution (a) and the preliminarily enriched germanium bearing solution (b) that are combined in advance, and performing elution, to obtain a germanium-rich solution.

The technical solutions of the present invention organically combine the advantages of mineral beneficiation, hydrometallurgy, and chemical preparation, greatly improving one-time direct hydrometallurgical germanium extraction and organic matter depolymerization. Specifically, the principle of the present invention is as follows:

First, germanium in germanium-rich lignite primarily exists in the form of germanium bound to organic matter and in the form of trace germanium-containing minerals. Efficient germanium enrichment can be hardly implemented by using conventional mineral beneficiation and enrichment methods. In addition, raw germanium-rich lignite usually contains a specific amount of mud that contains a low content of germanium and affects subsequent extraction. Therefore, low-germanium mud is first removed by mineral processing classification. This can reduce the impact of mud on subsequent extraction and can effectively lower the ash content of the germanium-rich lignite, helping improve purity of a subsequent humic acid product. Grinding an oversize product can help increase a specific surface area of the lignite, which is conducive to increasing a degree of subsequent pre-activation.

Then, germanium is extracted through a combined process of catalytic pre-oxidation and nitric acid leaching. Germanium in germanium-rich lignite usually exists in the form of germanium bound to organic matter ($Ge^{4+}$) and in the form of minerals, for example, germanium sulfide ($Ge^{2+}$). A degree of releasing germanium from germanium-rich lignite is limited in the related art. The present invention has found through research that first activation with hydrogen peroxide and a ferrous ion solution and then oxidation and leaching with nitric acid can significantly improve one-time direct hydrometallurgical germanium extraction and can significantly reduce consumption of a leaching agent and duration for leaching under heating. The primary principle is that a large amount of hydroxyl radicals can form from hydrogen peroxide through continuous transformation between ferrous ions and ferric ions under the catalysis of a specific amount of ferrous ions, and the free hydroxyl radicals in the solution can promote breakage of some chemical bonds in the germanium-rich lignite particles, resulting in more thorough fragmentation. In addition, the organic matter bonded to germanium is further dissociated, which is more conducive to subsequent oxidation and leaching with nitric acid. The formation of hydroxyl radicals during catalytic pre-oxidation in the present invention involves the following chemical reactions:

$H_2O_2+Fe^{2+}\rightarrow Fe^{3+}+HO^-+\cdot OH$ $RH+\cdot OH\rightarrow R\cdot+H_2O$ $R\cdot+Fe^{3+}\rightarrow Fe^{2+}+$oxidation product $H_2O_2+\cdot OH\rightarrow HO_2\cdot+H_2O$ $Fe^{2+}+OH\rightarrow Fe^{3+}+HO^-$ $Fe^{3+}+H_2O_2\rightarrow Fe^{2+}+H^++HO_2\cdot$ $Fe^{3+}+HO_2\cdot\rightarrow Fe^{2+}+H^++O_2$ In addition, the catalytic pre-oxidation and nitric acid oxidation in the present invention can simultaneously promote the activation of organic matter in the lignite and the depolymerization of macromolecular organic matter into humic acid, improving the activation and depolymerization of the organic matter in the germanium-rich lignite while extracting germanium, and producing a humic acid product with better structural characteristics.

Moreover, recycling the activated solution (a) and the germanium bearing solution (b) in the present invention can fully utilize the residual hydrogen peroxide, ferrous ion solution, and nitric acid, reducing the reagent consumption and germanium loss, and can break an equilibrium system in the solution, reducing the difficulty of subsequent impurity removal from germanium by using the anion exchange resin.

If the germanium-rich lignite is directly treated with hydrogen peroxide and a ferrous ion solution for catalytic pre-oxidation without sizing and mud removal, the germanium-rich lignite cannot be in sufficient contact with an activating reagent due to incomplete dissociation of the germanium-rich lignite, greatly reducing a one-time germanium leaching rate and a degree of depolymerization of organic matter.

As a preferred solution, the mineral processing classification is performed by using a high-frequency fine screen with a pore size of 74 μm to 150 μm, and a particle size is controlled to be 150 μm or less in the grinding step. Raw germanium-rich lignite usually contains a specific amount of mud that contains a low content of germanium and affects subsequent extraction, which needs to be removed through mineral processing classification. The fine screen with high vibration frequency used in the present invention can effectively break the adhesion between the germanium-rich lignite and the mud particles, and reduce the aggregation force between fine mud particles, significantly improving the efficiency of mud removal. Within the screen pore size range selected in the present invention, fine mud particles and coarse germanium-rich lignite can be effectively separated.

As a preferred solution, a molar ratio of the hydrogen peroxide to the ferrous ion solution is (35-60):1, where the ferrous ion solution is quantified based on a content of ferrous ions. A key to the present invention is controlling the molar ratio of hydrogen peroxide to ferrous ions. When an addition amount of $Fe^{2+}$ is low, $H_2O_2$ cannot produce ·OH efficiently but decomposes directly into $H_2O$ and $O_2$. When the addition amount of $Fe^{2+}$ is increased, ·OH production efficiency is excessively high, and excessive ·OH reacts with each other to produce $H_2O$ and $O_2$. Consequently, the lignite cannot be fully oxidized. In addition, the present invention differs significantly from the conventional Fenton's reagent in terms of the molar ratio. The conventional Fenton's reagent is primarily used for depolymerization of organic matter in wastewater, with a mass ratio of $H_2O_2$ to $Fe^{2+}$ usually ranging from 1:1 to 10:1 ("Technical Specifications of Fenton Oxidation Process for Wastewater Treatment" (HJ1095-2020)), and an optimal pH value for treatment of about 2.0 to 3.0, to thoroughly decompose the organic matter. In the present invention, the proportion of hydrogen peroxide is much higher than that in the conventional Fenton's reagent, and the concentration of ferrous ions in the activated system is low, so that the resulting capability to catalytically produce hydroxyl radicals from hydrogen peroxide is relatively weak. In this case, the germanium-rich lignite can be pre-oxidized, but the organic matter in the lignite is depolymerized and oxidized moderately, implementing the recovery of a humic acid product with better structural characteristics. If the ratio of the Fenton's reagent for high oxidation is adopted in the present invention, the organic matter in the present invention is over-oxidized, reducing a humic acid yield of the organic matter, and making it hard to perform subsequent solid-liquid separation. Further, the molar ratio is preferably (45-50):1, more preferably 50:1.

As a preferred solution, the catalytic pre-oxidation is performed under the following conditions: a liquid-solid ratio is (8-15):1, a temperature is 20° C. to 25° C., duration is 0.5 h to 1 h, and a concentration of the hydrogen peroxide is 2.0 mol/L to 4.0 mol/L. Further, the liquid-solid ratio is preferably (9-10):1, the duration is preferably 0.5 h to 0.6 h, and the concentration of the hydrogen peroxide is preferably 3 mol/L to 3.5 mol/L. More preferably, the liquid-solid ratio is 10:1, the duration is 0.5 h, and the concentration of the hydrogen peroxide is 3 mol/L.

As a preferred solution, the germanium leaching is performed under the following conditions: a concentration of the nitric acid is 0.7 mol/L to 1.2 mol/L, a liquid-solid ratio is (8-15):1, leaching duration is 0.5 h to 1 h, and a temperature is 85° C. to 95° C. During leaching in the present invention, a low concentration of the nitric acid, a low liquid-solid ratio, a low temperature, or short leaching duration can result in an incomplete leaching reaction of the germanium-rich lignite, reducing a germanium leaching rate. An excessively high concentration of the nitric acid, an excessively high liquid-solid ratio, an excessively high temperature, and excessively long duration can increase leaching costs. Therefore, it is necessary to complete efficient germanium leaching under appropriate conditions. Further, the concentration of the nitric acid is preferably 0.8 mol/L to 0.9 mol/L, the liquid-solid ratio is preferably (10-11):1, the leaching duration is preferably 0.5 h to 0.6 h, and the temperature is preferably 90° C. to 95° C. More preferably, the concentration of the nitric acid is 0.8 mol/L, the liquid-solid ratio is 10:1, the leaching duration is 0.5 h, and the temperature is 90° C.

As a preferred solution, a number of cycles for the recycling is 3 to 5. In the present invention, germanium can be extracted and enriched from the lignite multiple times through the recycling, reducing the loss of germanium in each treatment step, thereby increasing overall recovery of germanium. When the number of cycles for the recycling is excessively low, reuse of the residual reagent and preliminary germanium enrichment cannot be implemented.

As a preferred solution, the anion exchange resin is modified based on polyurethane resin, polyvinyl chloride resin, or polypropylene resin. These types of resin selected in the present invention have good oxidation resistance and corrosion resistance, which can improve stability of the overall extraction process in the present invention.

As a preferred solution, in the humic acid-rich solid product with the high degree of depolymerization, a humic acid yield is greater than or equal to 45%, and a humic acid ultraviolet characteristic parameter E4/E6 is greater than or equal to 9. E4/E6 is a ratio of ultraviolet absorbance of a humic acid solution at a wavelength of 465 nm to ultraviolet absorbance of the humic acid solution at a wavelength of 665 nm by UV-vis measurement. This value is also referred to as a humification index. The E4/E6 value represents a degree of depolymerization of humic acid. A high E4/E6 value indicates a small molecular weight and a high aliphatic compound content. The humic acid-rich solid product obtained through the beneficiation-metallurgy-chemical combination process in the present invention has good structural characteristics and a high yield of humic acid, which is conducive to the use of the humic acid-rich solid product in fields with high requirements for activity.

Compared with the related art, the present invention has the following beneficial effects:

(1) According to the present invention, through the combination of mineral beneficiation, hydrometallurgy, and chemical preparation, high carbon emission and organic resource waste during enrichment from germanium-rich lignite by conventional pyrometallurgical processing are effectively avoided, and raw materials are provided for the metallurgical and agricultural industries, offering the advantages of reduced environmental pollution, high extraction efficiency, and low comprehensive costs.

(2) In the present invention, through pre-activation of germanium-rich lignite by catalytic oxidation, a one-time direct hydrometallurgical germanium extraction rate can reach 80% or more, and consumption of a leaching agent and duration for leaching under heating are significantly reduced compared with direct acid leaching, improving organic matter activation, depolymerization, and extraction. In addition, the present invention can greatly reduce a length of a comprehensive utilization technology route, effectively reducing costs of the overall process.

(3) The catalytic pre-oxidation and nitric acid oxidation in the present invention can simultaneously promote the activation of organic matter in the lignite and the depolymerization of macromolecular organic matter into humic acid, improving the activation and depolymerization of the organic matter in the germanium-rich lignite while extracting germanium, and producing a humic acid product with better structural characteristics. In the humic acid-rich solid product, the humic acid yield is greater than or equal to 45%, and the humic acid ultraviolet characteristic parameter E4/E6 is greater than or equal to 9.

(4) In the present invention, a high molar ratio of hydrogen peroxide to ferrous ions can implement pre-oxidation of germanium-rich lignite and controlled degradation of organic matter.

(5) Recycling the activated solution (a) and the germanium bearing solution (b) in the present invention can fully utilize the residual hydrogen peroxide, ferrous ion solution, and nitric acid, reducing the reagent consumption and germanium loss.

BRIEF DESCRIPTION OF THE DRAWINGS

FIG. 2A shows raw lignite without treatment, and FIG. 2B shows lignite treated by catalytic pre-oxidation and nitric acid leaching according to the present invention.

DETAILED DESCRIPTION OF THE EMBODIMENTS

Figure 1:
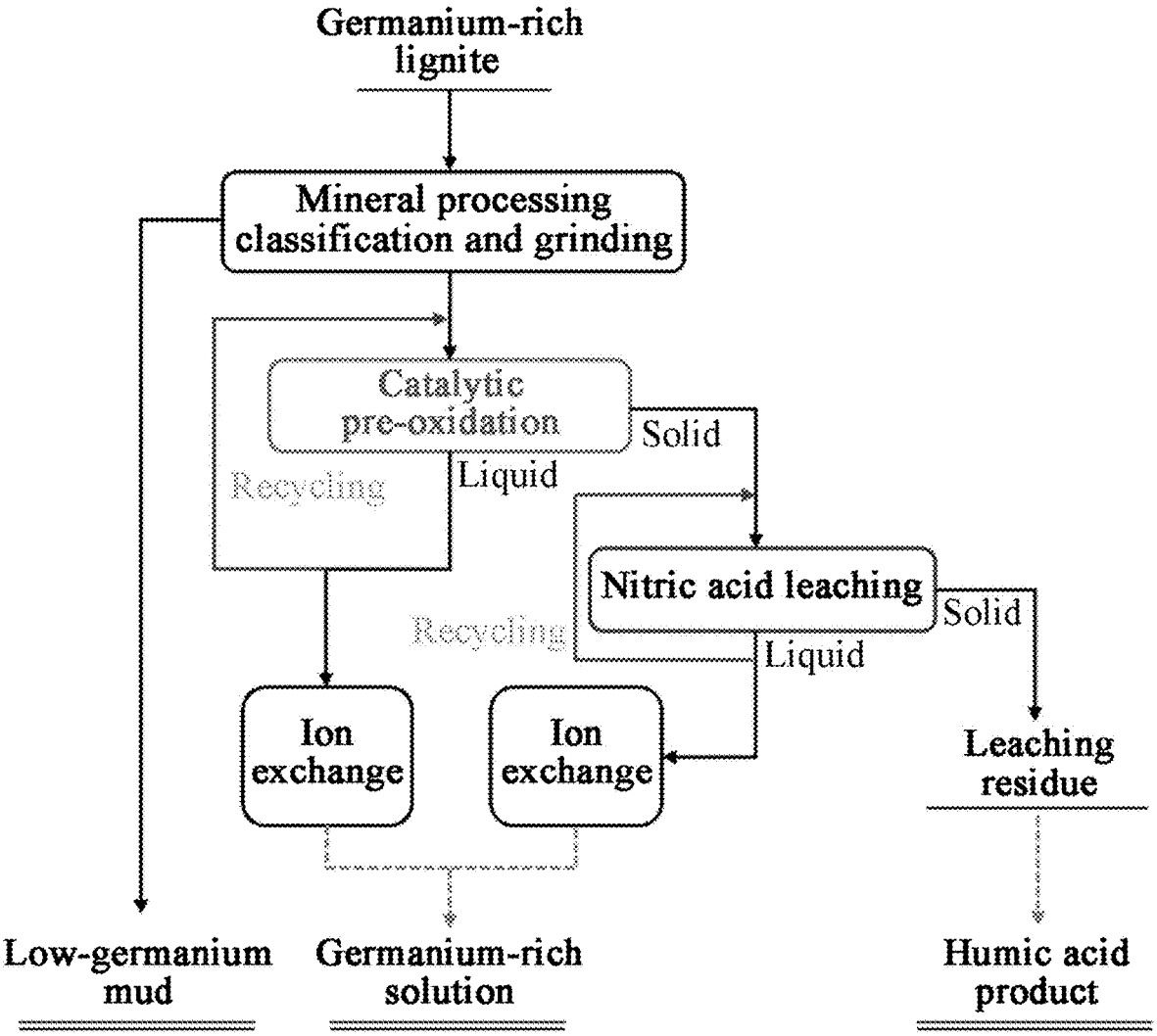
FIG. 1 is a schematic flowchart of a comprehensive utilization process of beneficiation-metallurgy-chemical combination for germanium-rich lignite according to the present invention.

The following describes the technical solutions in embodiments of the present invention clearly and completely with reference to the accompanying drawings in the embodiments of the present invention. Apparently, the described embodiments are merely some rather than all of the embodiments of the present invention. All other embodiments obtained by a person of ordinary skill in the art based on the embodiments of the present invention without creative efforts shall fall within the protection scope of the present invention.

Embodiment 1

Raw lignite containing 210 μg/g of germanium from Yunnan was first sized by using a high-frequency fine screen to remove fine mud particles smaller than a 200 mesh size (74 μm), and an oversize product was ground to a particle size of 150 μm or less to be used as feedstock for subsequent treatment. The feedstock was taken and subjected to catalytic pre-activation under the following conditions: a concentration of hydrogen peroxide was 3.0 mol/L, a concentration of ferrous ions was 0.06 mol/L (in the solution, $H_2O_2/Fe^{2+}$=50:1), a reaction liquid-solid ratio was 10:1, treatment duration was 1 h, and a treatment temperature was room temperature. After the catalytic pre-activation, solid-liquid separation was performed to obtain an activated solution (a) and an activated lignite residue. The activated solution (a) was recycled three times to implement preliminary enrichment. Next, polyurethane-modified anion exchange resin was used to adsorb germanium. Then, germanium elution was performed for enrichment to obtain a preliminarily enriched germanium bearing solution (a). The activated lignite residue obtained at the catalytic activation stage was used for nitric acid leaching.

The activated lignite residue was treated with a 0.8 mol/L nitric acid solution to react for leaching germanium out under the following conditions: a liquid-solid ratio was 10:1, a leaching temperature was controlled to 90° C., and reaction duration was 0.5 h. After leaching, solid-liquid separation was performed to obtain a germanium bearing solution (b) and a humic acid-rich solid product with a high degree of depolymerization. The germanium bearing solution (b) was recycled three times to implement preliminary germanium enrichment. Polypropylene-modified anion exchange resin was used to adsorb germanium. Then, germanium elution was performed for enrichment to obtain a preliminarily enriched germanium bearing solution (b). The preliminarily enriched germanium bearing solution (a) and the preliminarily enriched germanium bearing solution (b) were combined for subsequent germanium extraction.

Through the foregoing treatment, a one-time direct hydrometallurgical extraction rate of germanium from the raw germanium-rich lignite can reach 85.33%, a humic acid yield reaches 49.16% or more, and a humic acid ultraviolet characteristic parameter E4/E6 reaches 9.54.

Figure 2A:
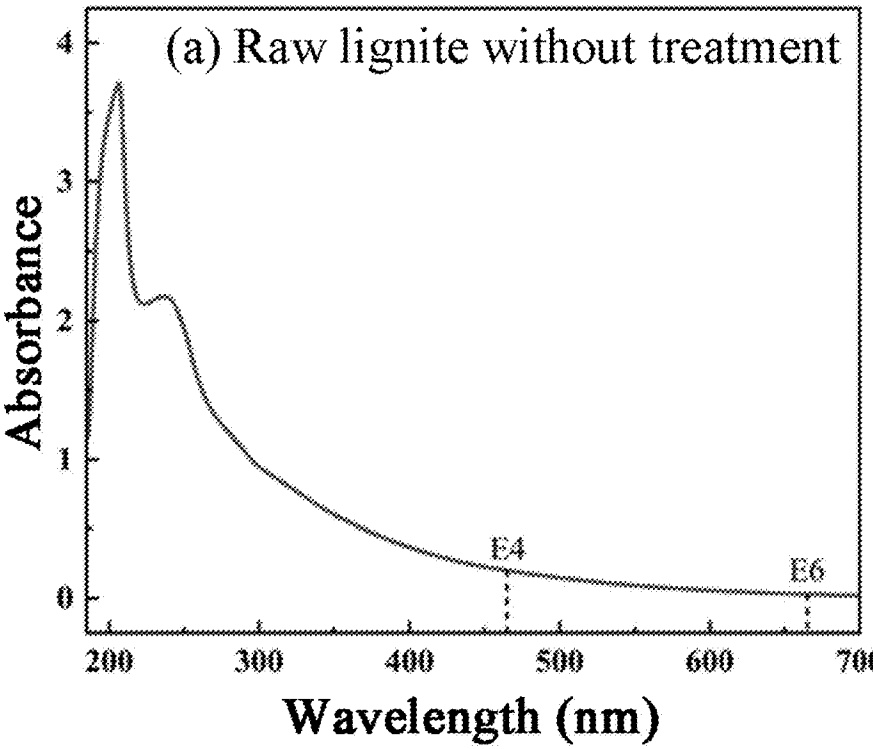
FIGS. 2A-2B show ultraviolet-visible spectra of humic acid obtained before and after treatment on germanium-rich lignite under same testing conditions according to Embodiment 1 of the present invention, where
Figure 2B:
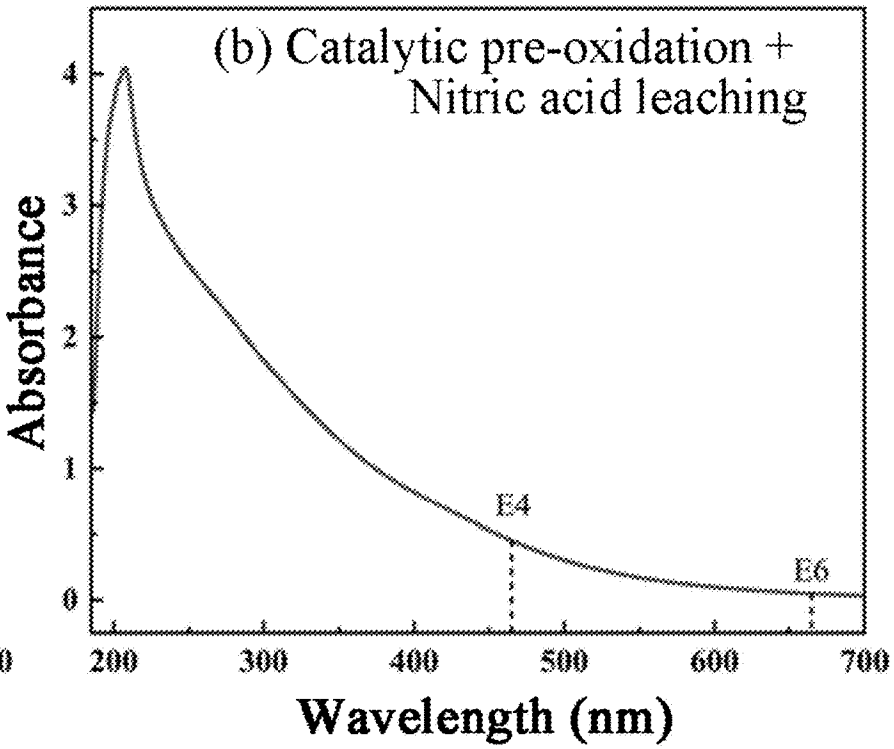

FIGS. 2A-2B show ultraviolet-visible spectra of humic acid obtained before and after treatment on germanium-rich lignite under same testing conditions according to Embodiment 1 of the present invention, where FIG. 2A shows raw lignite without treatment, and FIG. 2B shows lignite treated by catalytic pre-oxidation and nitric acid leaching according to the present invention. It can be learned from the figure that, through the treatment of the present invention, the obtained humic acid ultraviolet characteristic parameter E4/E6 is significantly increased, and a product with a higher degree of depolymerization is obtained.

Embodiment 2

Other conditions are the same as those in Embodiment 1. The difference lies in that: a concentration of hydrogen peroxide is changed to 2.0 mol/L, and a concentration of ferrous ions is changed to 0.04 mol/L (maintaining $H_2O_2/Fe^{2+}$=50:1 in the solution). Other experimental parameters and steps are the same as those in Embodiment 1. Finally, a one-time direct hydrometallurgical extraction rate of germanium is 80.34%, a humic acid yield is 45.37%, and a degree of depolymerization E4/E6 of humic acid is 9.06.

Compared with Embodiment 1, with the same liquid-solid ratio in this embodiment, as the concentration of hydrogen peroxide changes, the concentration of ferrous ions changes, and a concentration of hydroxyl radicals in the solution also changes, affecting catalytic oxidation of the germanium-rich lignite, and consequently affecting the extraction rate and the yield.

Embodiment 3

Other conditions are the same as those in Embodiment 1. The difference lies in that: a concentration of nitric acid is changed to 1.2 mol/L. Other experimental parameters and steps are the same as those in Embodiment 1. Finally, recovery of germanium is 86.50%, a humic acid yield is 47.25%, and a degree of depolymerization E4/E6 of humic acid is 9.13.

Embodiment 4

Other conditions are the same as those in Embodiment 1. The difference lies in that: a liquid-solid ratio for nitric acid leaching is changed to 12.5:1. Other experimental parameters and steps are the same as those in Embodiment 1. Finally, recovery of germanium is 80.96%, a humic acid yield is 47.06%, and a degree of depolymerization E4/E6 of humic acid is 9.28.

Embodiment 5

Raw lignite containing 210 μg/g of germanium from Yunnan was first sized by using a high-frequency fine screen to remove fine mud particles smaller than a 150 mesh size (100 μm), and an oversize product was ground to a particle size of 150 μm or less to be used as feedstock for subsequent treatment. The feedstock was taken and subjected to catalytic pre-activation under the following conditions: a concentration of hydrogen peroxide was 3.0 mol/L, a concentration of ferrous ions was 0.06 mol/L (in the solution, $H_2O_2/Fe^{2+}$=50:1), a reaction liquid-solid ratio was 9:1, treatment duration was 0.6 h, and a treatment temperature was room temperature. After the catalytic pre-activation, solid-liquid separation was performed to obtain an activated solution (a) and an activated lignite residue. The activated solution (a) was recycled four times to implement preliminary enrichment. Next, polyurethane-modified anion exchange resin was used to adsorb germanium. Then, germanium elution was performed for enrichment to obtain a preliminarily enriched germanium bearing solution (a). The activated lignite residue obtained at the catalytic activation stage was used for nitric acid leaching.

The activated lignite residue was treated with a 0.8 mol/L nitric acid solution to react for leaching germanium out under the following conditions: a liquid-solid ratio was 11:1, a leaching temperature was controlled to 92° C., and reaction duration was 0.6 h. After leaching, solid-liquid separation was performed to obtain a germanium bearing solution (b) and a humic acid-rich solid product with a high degree of depolymerization. The germanium bearing solution (b) was recycled four times to implement preliminary germanium enrichment. Polypropylene-modified anion exchange resin was used to adsorb germanium. Then, germanium elution was performed for enrichment to obtain a preliminarily enriched germanium bearing solution (b). The preliminarily enriched germanium bearing solution (a) and the preliminarily enriched germanium bearing solution (b) were combined for subsequent germanium extraction.

Through the foregoing treatment, a one-time direct hydrometallurgical extraction rate of germanium from the raw germanium-rich lignite can reach 84.61%, a humic acid yield reaches 48.02% or more, and a humic acid ultraviolet characteristic parameter E4/E6 reaches 9.33.

Comparative Example 1

Other conditions are the same as those in Embodiment 1. The difference lies in that: raw lignite was not sized by using a high-frequency fine screen to remove fine mud particles smaller than a 200 mesh size (74 μm). Other experimental parameters and steps are the same as those in Embodiment 1. Finally, recovery of germanium is 79.58%, a humic acid yield is 43.07%, and a degree of depolymerization E4/E6 of humic acid is 6.93.

Comparative Example 2

Other conditions are the same as those in Embodiment 1. The difference lies in that: a concentration of ferrous ions is changed to 0.04 mol/L (in the solution, $H_2O_2/Fe^{2+}$=75:1). Other experimental parameters and steps are the same as those in Embodiment 1. Finally, recovery of germanium is 64.00%, a humic acid yield is 35.64%, and a degree of depolymerization E4/E6 of humic acid is 7.42.

Comparative Example 3

Other conditions are the same as those in Embodiment 1. The difference lies in that: a concentration of ferrous ions is changed to 0.12 mol/L (in the solution, $H_2O_2/Fe^{2+}$=25:1). Other experimental parameters and steps are the same as those in Embodiment 1. Finally, recovery of germanium is 67.26%, a humic acid yield is 32.29%, and a degree of depolymerization E4/E6 of humic acid is 7.17.

Comparative Example 4

Other conditions are the same as those in Embodiment 1. The difference lies in that: a concentration of nitric acid is changed to 0.6 mol/L. Other experimental parameters and steps are the same as those in Embodiment 1. Finally, recovery of germanium is 64.34%, a humic acid yield is 37.94%, and a degree of depolymerization E4/E6 of humic acid is 8.25.

Comparative Example 5

Other conditions are the same as those in Embodiment 1. The difference lies in that: a temperature for nitric acid leaching is changed to 70° C. Other experimental parameters and steps are the same as those in Embodiment 1. Finally, recovery of germanium is 40.06%, a humic acid yield is 39.26%, and a degree of depolymerization E4/E6 of humic acid is 8.74.

Comparative Example 6

Other conditions are the same as those in Embodiment 1. The difference lies in that: feedstock is not subjected to catalytic pre-oxidation but is directly treated with a 1 mol/L nitric acid solution for leaching. Other experimental parameters and steps are the same as those in Embodiment 1. Finally, recovery of germanium is 57.95%, a humic acid yield is 43.19%, and a degree of depolymerization E4/E6 of humic acid is 9.06.

The foregoing descriptions are merely specific preferred implementations of the present invention and some cases in the technological exploration process of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A beneficiation-metallurgy-chemical combination method for a germanium-rich lignite, comprising the following steps:

1) performing a mineral processing classification on the germanium-rich lignite to remove mud particles to obtain an oversize product, and grinding the oversize product to obtain a raw lignite;
2) mixing the raw lignite, hydrogen peroxide, and a ferrous ion solution to perform a catalytic pre-oxidation, performing a first solid-liquid separation to obtain an activated solution and an activated lignite residue, and returning the activated solution to the catalytic pre-oxidation step for a first recycling, to obtain a first preliminarily enriched germanium bearing solution;
3) performing a germanium leaching on the activated lignite residue with nitric acid, performing a second solid-liquid separation to obtain a germanium bearing solution and a humic acid-rich solid product with a high degree of depolymerization, and returning the germanium bearing solution to the germanium leaching step for a second recycling, to obtain a second preliminarily enriched germanium bearing solution; and
4) performing an adsorption with an anion exchange resin on the first preliminarily enriched germanium bearing solution and the second preliminarily enriched germanium bearing solution separately or on a combination of the first preliminarily enriched germanium bearing solution and the second preliminarily enriched germanium bearing solution, and performing an elution to obtain a germanium-rich solution, wherein a molar ratio of the hydrogen peroxide to ferrous ions in the ferrous ion solution is (35-60):1.

2. The beneficiation-metallurgy-chemical combination method for the germanium-rich lignite according to claim 1, wherein the mineral processing classification is performed by using a fine screen with a pore size of 74 μm to 150 μm, and a particle size of the raw lignite is controlled to be 150 μm or less in the grinding.

3. The beneficiation-metallurgy-chemical combination method for the germanium-rich lignite according to claim 2, wherein the molar ratio of the hydrogen peroxide to the ferrous ions in the ferrous ion solution is (45-50):1.

4. The beneficiation-metallurgy-chemical combination method for the germanium-rich lignite according to claim 2, wherein the germanium leaching is performed under the following conditions: a concentration of the nitric acid is 0.7 mol/L to 1.2 mol/L, a liquid-solid ratio is (8-15) mL:1 g, a leaching duration is 0.5 h to 1 h, and a temperature is 85° C. to 95° C.

5. The beneficiation-metallurgy-chemical combination method for the germanium-rich lignite according to claim 4, wherein a number of cycles for the first recycling or the second recycling is 3 to 5.

6. The beneficiation-metallurgy-chemical combination method for the germanium-rich lignite according to claim 1, wherein the molar ratio of the hydrogen peroxide to the ferrous ions in the ferrous ion solution is (45-50):1.

7. The beneficiation-metallurgy-chemical combination method for the germanium-rich lignite according to claim 1, wherein the catalytic pre-oxidation is performed under the following conditions: a liquid-solid ratio is (8-15) mL:1 g, a temperature is 20° C. to 25° C., a duration is 0.5 h to 1 h, and a concentration of the hydrogen peroxide is 2.0 mol/L to 4.0 mol/L.

8. The beneficiation-metallurgy-chemical combination method for the germanium-rich lignite according to claim 7, wherein the germanium leaching is performed under the following conditions: a concentration of the nitric acid is 0.7 mol/L to 1.2 mol/L, a liquid-solid ratio is (8-15) mL:1 g, a leaching duration is 0.5 h to 1 h, and a temperature is 85° C. to 95° C.

9. The beneficiation-metallurgy-chemical combination method for the germanium-rich lignite according to claim 8, wherein a number of cycles for the first recycling or the second recycling is 3 to 5.

10. The beneficiation-metallurgy-chemical combination method for the germanium-rich lignite according to claim 1, wherein the germanium leaching is performed under the following conditions: a concentration of the nitric acid is 0.7 mol/L to 1.2 mol/L, a liquid-solid ratio is (8-15) mL:1 g, a leaching duration is 0.5 h to 1 h, and a temperature is 85° C. to 95° C.

11. The beneficiation-metallurgy-chemical combination method for the germanium-rich lignite according to claim 10, wherein a number of cycles for the first recycling or the second recycling is 3 to 5.

12. The beneficiation-metallurgy-chemical combination method for the germanium-rich lignite according to claim 1, wherein the anion exchange resin is modified using polyurethane resin, polyvinyl chloride resin, or polypropylene resin.

13. The beneficiation-metallurgy-chemical combination method for the germanium-rich lignite according to claim 12, wherein in the humic acid-rich solid product with the high degree of depolymerization, a humic acid yield of the humic acid-rich solid product is greater than or equal to 45%, and a humic acid ultraviolet characteristic parameter E4/E6 is greater than or equal to 9.

* * * * *